US007148852B2

(12) United States Patent
Pathak et al.

(10) Patent No.: US 7,148,852 B2
(45) Date of Patent: Dec. 12, 2006

(54) MOBILE WIRELESS COMMUNICATION DEVICE ANTENNA SYSTEMS AND METHODS

(75) Inventors: Vaneet Pathak, San Diego, CA (US); Thomas Arnold, Carlsbad, CA (US); Gregory Poilasne, San Diego, CA (US); Douglas C. Burstedt, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 71 days.

(21) Appl. No.: 11/100,086

(22) Filed: Apr. 5, 2005

(65) Prior Publication Data

US 2006/0220965 A1 Oct. 5, 2006

(51) Int. Cl.
*H01Q 1/24* (2006.01)

(52) U.S. Cl. ..... 343/702

(58) Field of Classification Search ..... 343/702, 343/895; 455/90, 575
See application file for complete search history.

(56) References Cited

U.S. PATENT DOCUMENTS 6,163,302 A 12/2000 Bjorkengren et al.
6,212,413 B1 4/2001 Kiesi
6,377,827 B1 4/2002 Rydbeck
7,023,389 B1 * 4/2006 Demicco et al. ..... 343/702
7,050,008 B1 * 5/2006 Saito et al. ..... 343/702
2002/0070903 A1 6/2002 Nakamura et al.
2004/0051671 A1 3/2004 Wei
2004/0207558 A1 10/2004 Saito et al.

OTHER PUBLICATIONS

Z200—Product home—Polyphonic 40-voice sound—Style-Up Covers Mobile phone, Copyright 2001-2005 Sony Ericsson Mobile Communications AB. http://www.sonyericsson.com.

* cited by examiner

*Primary Examiner*—Hoang V. Nguyen

(57) ABSTRACT

An antenna with a loop portion that arches away from the body of the mobile wireless communication device. The loop portion is connected to the mobile wireless communication device at one end and detachably connected or grounded to the mobile wireless communication device at the other end. An antenna that arches away from the body of a phone, but connects at both ends to the body of the phone has improved performance over an internal antenna, and yet retains the advantages of an internal antenna. Further, if the antenna is detachably connected to the phone at one end, then either better performance can be achieved if the antenna can be moved further away from the body of the phone, or the antenna can be used as a latch to attach the phone to slender objects.

22 Claims, 4 Drawing Sheets

MOBILE WIRELESS COMMUNICATION DEVICE ANTENNA SYSTEMS AND METHODS

BACKGROUND OF THE INVENTION

1. Field of the Invention

The invention relates generally to wireless communications and more particularly to systems and methods for antenna functionality and performance.

2. Background

Consumers are demanding smaller and smaller mobile wireless communication devices, such as, for example, cell phones. One component of the demand for smaller and smaller wireless communication devices is a preference for internal antennas. External antennas typically have better performance, partially because the antenna can typically be positioned away from the other electronic components of the wireless communication device and away from the user's body. But external antennas are often bulky, tend to catch on clothing and other personal items and are commonly considered cosmetically less pleasing by many consumers. Thus, there is a great demand for internal antennas, and yet the antenna performance should not be sacrificed compared to external antennas.

SUMMARY OF THE INVENTION

In order to overcome the problems associated with conventional mobile wireless communication device antennas, an antenna with a loop portion that arches away from the body of the device is provided. The loop portion is connected to the mobile wireless communication device at one end and detachably connected to the mobile wireless communication device or grounded at the other end.

An antenna that arches away from the body of a phone, but connects at both ends to the body of the phone has improved performance over an internal antenna, and yet retains the advantages of an internal antenna. Further, if the antenna is detachably connected to the phone at one end, then either better performance can be achieved if the antenna can be moved further away from the body of the phone, or the antenna can be used as a latch to attach the phone to slender objects, such as, for example, a belt loop.

Other aspects, advantages, and novel features of the invention will become apparent from the following Detailed Description, when considered in conjunction with the accompanying drawings.

BRIEF DESCRIPTION OF THE DRAWINGS

Preferred embodiments of the present inventions taught herein are illustrated by way of example, and not by way of limitation, in the figures of the accompanying drawings, in which.

DETAILED DESCRIPTION

Figure 1:
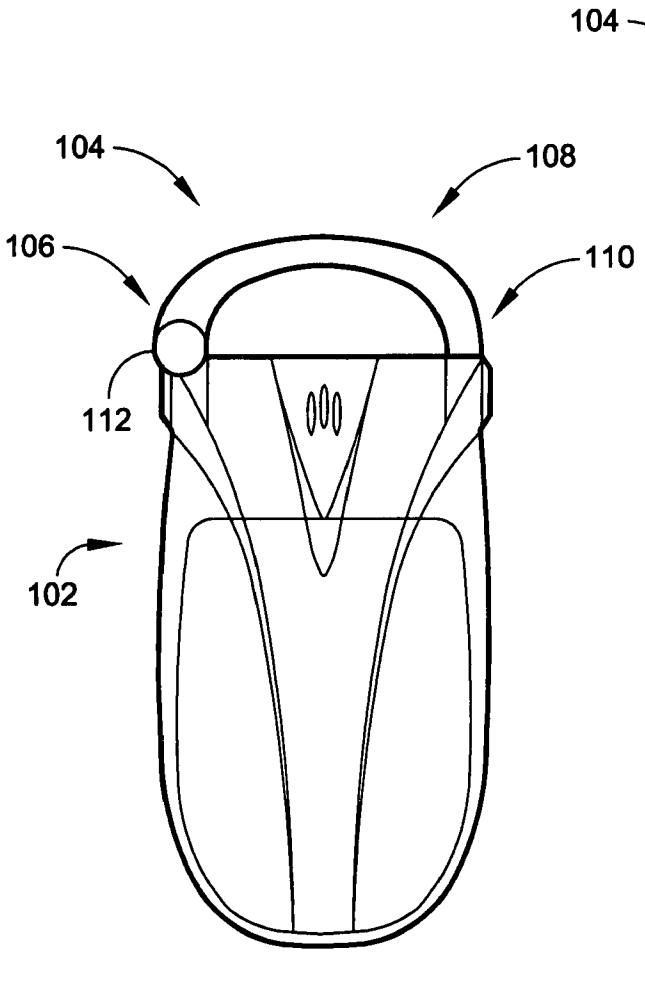
FIG. 1 illustrates a rear view of a mobile wireless communication device with a detachable hook antenna in a closed position.

FIG. 1 illustrates a rear view of a mobile wireless communication device, such as a cell phone, or mobile handset 102. The mobile handset 102 has an antenna 104 connected to the handset 102. The antenna 104 includes a first connecting portion 106, a loop portion 108 and a second connecting portion 110. The second connecting portion is detachably connectable to the handset 102, as will be described more fully below with respect to FIG. 2. A hinge 112 connects the first connecting portion to the mobile handset 102.

Figure 2:
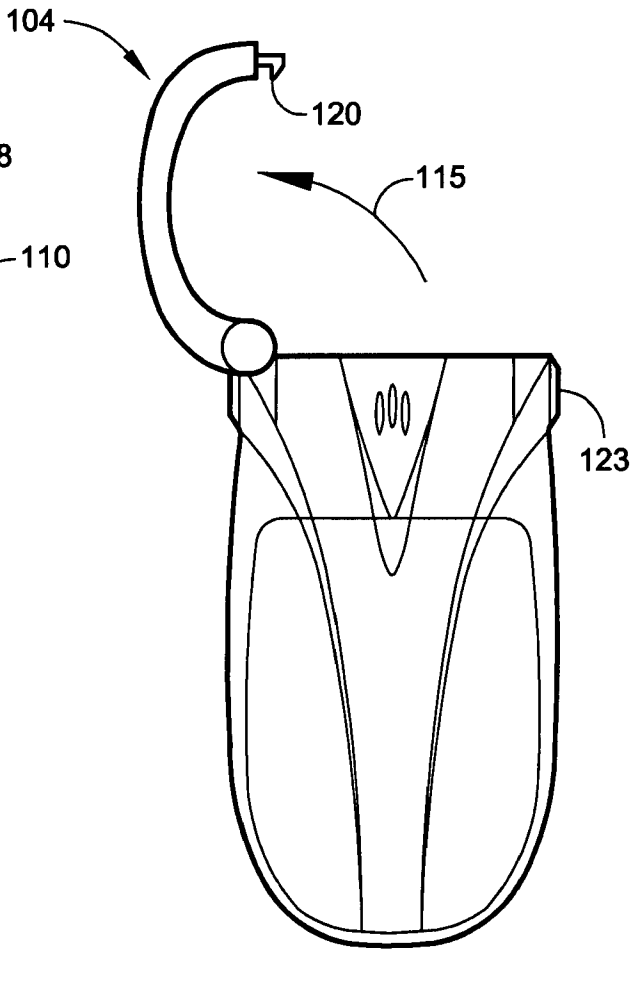
FIG. 2 illustrates a rear view of the mobile wireless communication device of FIG. 1, with the antenna in an open position.

Referring to FIG. 2, mobile handset 102 is shown with antenna 104 in an open position. As shown by arrow 115, antenna 104 has been rotated away from mobile handset 102. Second antenna connecting portion 110 is connected to first latch connecting portion 120. A second latch connecting portion (not shown in FIG. 2) is internal to handset 102 and mates to first latch connecting portion 120 when antenna 104 is in a closed position, as shown with respect to FIG. 1. A button 123 can be depressed to release antenna 104.

Figure 3:
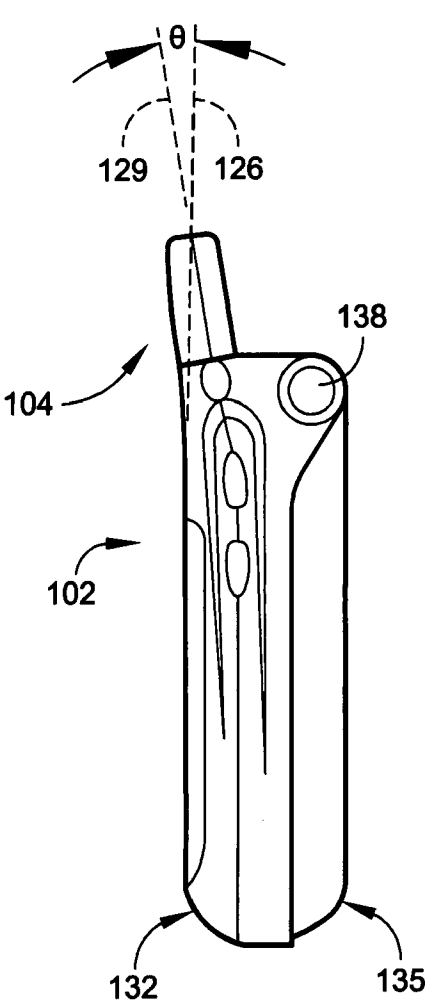
FIG. 3 illustrates a side view of the mobile wireless communication device of FIG. 1, with the antenna in a closed position.

FIG. 3 illustrates a side view of mobile handset 102. Mobile handset 102 has a back plane, as shown by dashed line 126. Antenna 104 generally forms an antenna plane, as shown by dashed line 129. Back plane 126 and antenna plane 129 are separated by angle θ. Angle θ may be zero to eight degrees, or more specifically, seven to eight degrees. Tilting antenna 104 at angle θ away from mobile handset 102 helps keep antenna 104 away from a user (not shown) when mobile handset is in use.

Mobile handset 102 includes first housing portion 132 and second housing portion 135. Hinge 138 connects first housing portion 132 to second housing portion 135 and provides for rotation between first and second housing portions 132 and 135. As shown in FIG. 3, first and second housing portions 132 and 135 are rotated together in what is known as a closed configuration. As shown, mobile handset 102 is what is commonly known as a flip phone, or clamshell phone. Alternatively, first housing portion 132 and second housing portion 135 could swivel with respect to each other to open.

Figure 4:
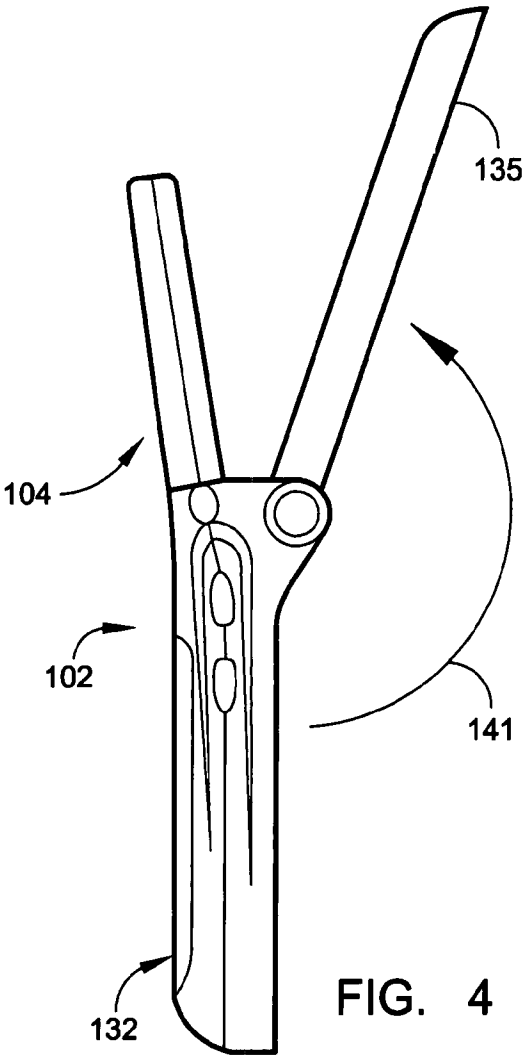
FIG. 4 illustrates a side view of the mobile wireless communication device of FIG. 1, with the antenna in an open position.

FIG. 4 illustrates a side view of mobile handset 102 in an open configuration. Second housing portion 135 has been rotated with respect to first housing portion 132, as shown by arrow 141. Second handset portion 135 has an axis of rotation with respect to first handset portion 132, in the center of hinge 138 coming out of the page, shown with respect to FIGS. 3–4. Antenna 104 has a different axis of rotation with respect to first handset portion 132, in the center of hinge 112 coming out of the page, shown with respect to FIGS. 1–2. Since FIGS. 1–2 are rear views and FIGS. 3–4 are side views, the axes of rotation shown with respect to hinges 112 and 138 are not parallel. If fact, the axes of rotation are significantly skewed, and form a ninety degree angle when projected onto two parallel planes in which the respective axes of rotation lie.

Figure 5:
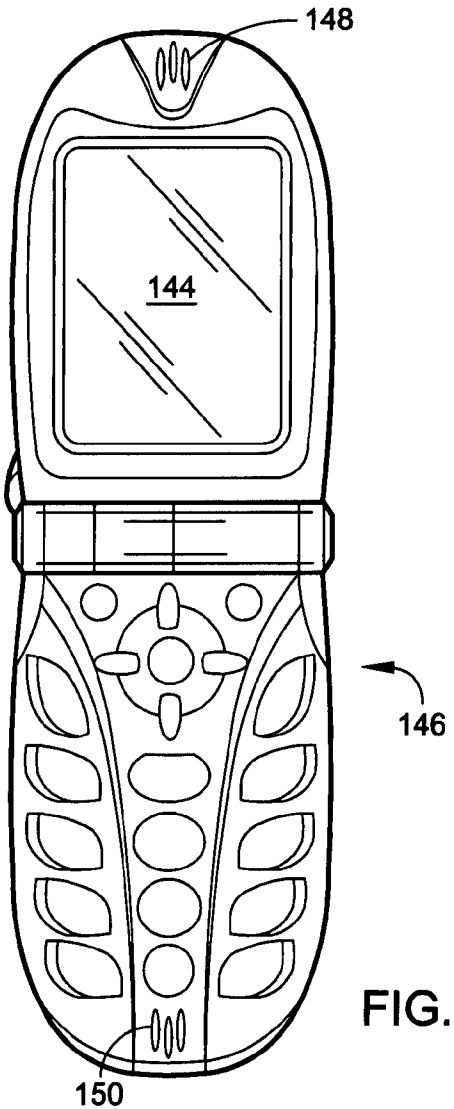
FIG. 5 illustrates a front view of the mobile wireless communication device of FIG. 1.

FIG. 5 illustrates a front view of mobile handset 102 in the open configuration shown with respect to FIG. 4. Mobile handset 102 includes several user interface devices such as a display screen 144, a keypad 146, a speaker 148 and a microphone 148. Mobile handset 102 also includes many internal components that are not shown. A transceiver is connected to antenna 104, a processor is connected to the transceiver for modulating and demodulating the communication signals. A memory is connected to the processor for storing information needed by the mobile handset. Further, a portable power supply, such as a battery, is connected to the transceiver and to the processor for supplying power.

Figure 6:
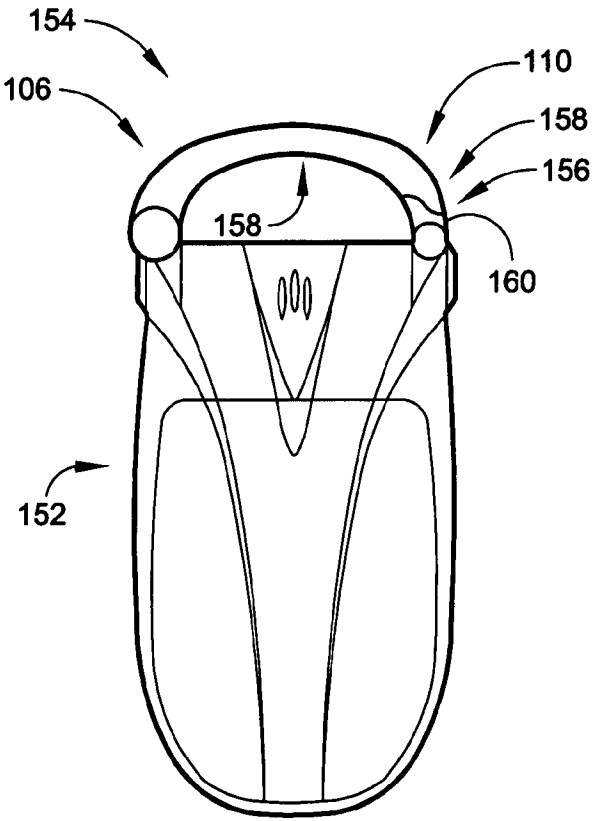
FIG. 6 illustrates a rear view of an alternate mobile wireless communication device, with an antenna latch in a closed position.

FIG. 6 illustrates a mobile handset 152 similar to mobile handset 102 (described with respect to FIGS. 1–5), except that mobile handset 152 has a fixed antenna 154 that is in a fixed position relative to first housing portion 132 of handset 152. Fixed antenna 154 has caribiner latch 156. Caribiner latch 156 has an antenna caribiner latch portion 158 and a handset caribiner latch portion 160. The handset caribiner latch portion 160 is rotatably connected to handset 152 by caribiner latch hinge 164.

Figure 7:
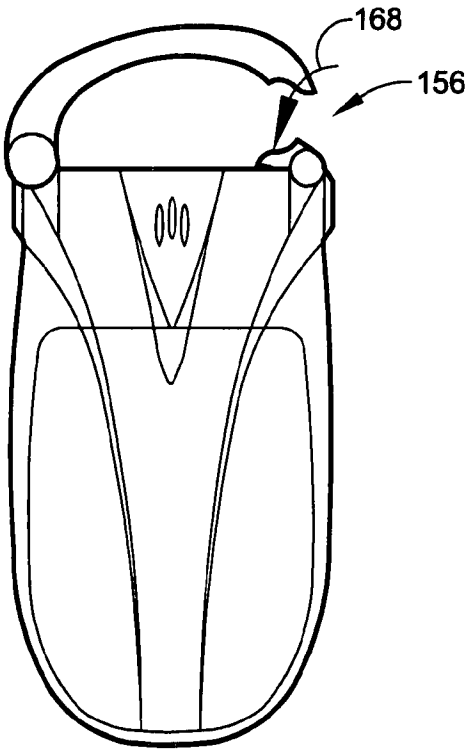
FIG. 7 illustrates a rear view of the mobile wireless communication device of FIG. 6, with the antenna latch in an open position.

Referring to FIG. 7, handset caribiner latch portion 156 can be rotated inward, as shown by arrow 168. Accordingly, handset 152 can be clipped to a thin object, such as, for example, a belt loop or a purse strap. Handset caribiner latch portion 156 can be pushed inward simply by applying pressure. That is, it is not necessary to additionally depress a button to move handset caribiner latch portion inward. Thus, handset 152 can be clipped to a thin object simply with only one hand. Alternatively, a button could be included. It could be necessary to depress the button in order to move handset caribiner latch portion 156 inward.

Figure 8:
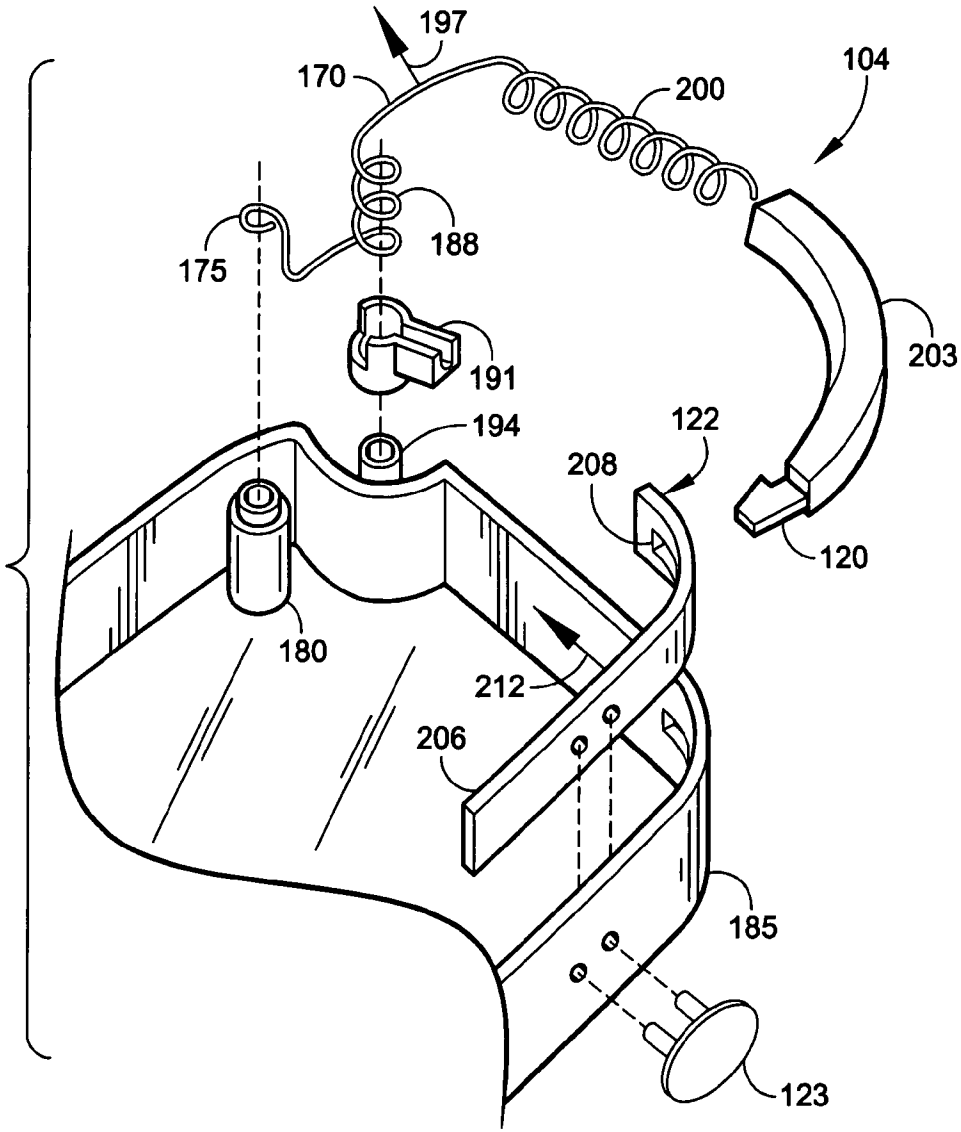
FIG. 8 illustrates an expanded partial view of the mobile wireless communication device of FIG. 1.

FIG. 8 shows an expanded internal view of the antenna 104 and latch 120 of handset 102. Antenna 104 includes a wire 170. The first wire portion is feed point 175. A screw (not shown) connects antenna feed point 175 to a printed wire board (PWB) (not shown). The PWB is located between antenna feed point 175 and antenna feed mounting post 180. The screw fastens antenna feed point 175 and the PWB to antenna feed mounting post 180. Antenna feed mounting post 180 is part of first handset portion case 185. Antenna feed point 175 could be connected to PWB by other means than a screw, which will not be discussed here.

Wire 170 is formed into loading spring 188. Loading spring 188 fits inside pivot actuator 192. Pivot actuator 191 fits over pivot post 194. Wire 170 is also formed into antenna radiator 200, shown as antenna coil 200. Antenna coil 200 is the primary source of radiation of electromagnetic signals by antenna 104. Loading spring 188 is loaded in the direction of arrow 197. Accordingly, loading spring 188 tends to push antenna coil 200 away from handset case 185.

Antenna coil 200 is covered by antenna sheath 203. Antenna sheath 203 fastens to pivot actuator 191. Pivot actuator 191 applies force from loading spring 188 to antenna sheath 203, thereby applying force to antenna coil 200.

Antenna sheath 203 includes first latch portion 120. First latch portion 120 is detachably connectable to handset case 185. More specifically, first latch portion 120 is detachably connectable to second latch portion 122. Second latch portion 120 comprises latch bar spring 206 with hole 209. Latch bar spring 206 is connected to handset case 185 (shown not connected for clarity). When fist latch portion 120 is inserted in hole 209, second latch portion 122 secures antenna 104 against handset case 185.

Button 123 is connected to latch bar spring for moving latch bar spring in the direction of arrow 212. When latch bar spring 206 is moved in the direction of arrow 212, first latch portion 120 is disengaged from hole 209, allowing antenna 104 to move away from handset case 185 under the force of loading spring 188.

Advantageously, better antenna performance can be achieved by rotating the antenna away from the body of the handset. Even in the closed position, or, alternatively, if the antenna is fixed with respect to the handset body (as shown with respect to FIGS. 6–7), antenna performance is improved because the antenna is positioned away from the handset by antenna loop portion. Yet, the advantages of an internal antenna are maintained. Further, the antenna can be used as a detachable clip for connecting to thin items, such as, for example, a belt loop or a purse strap.

Figure 11:
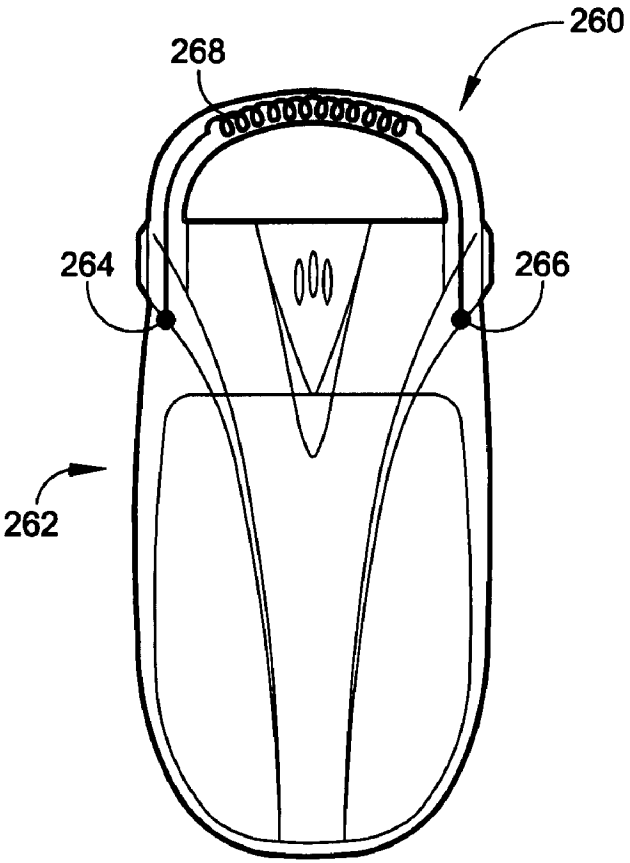
FIG. 11 illustrates a rear view of a mobile wireless communication device, with an antenna having a feed point and a ground connection.

FIG. 11 illustrates a rear view of a wireless communication device having a loop antenna 260 fixed at both ends to handset 262. Loop antenna 260 includes feed point 264 for connection to an antenna feed on a PWB (not shown) and ground point 266 for connection to a ground plane on a PWB (not shown). Ground point 266 may be a spring contact for connecting to the PWB. Antenna 260 also includes loop radiator 268, shown as a loop coil radiator 268.

Alternatively, loop antenna 260 could be detachably connectable at at least one end of loop antenna 260 from handset 262, similarly to the handsets 102 and 152, shown with respect to FIGS. 1–8. However, in that case an electromechanical connection would have to be made through latch portion 120 or 158.

Mobile handset 102 is shown with respect to FIGS. 1–7 and 11 as a flip, or clamshell, phone having two rotatable housing portions. However, an antenna with a loop portion as described with respect to FIGS. 1–7 and 11 (and below with respect to FIGS. 9–10) can be applied to a mobile handset 102 with only one housing portion. Such mobile handsets are commonly known in the industry as "candy bar phones" or "brick phones". In that case, referring to FIGS. 3–4, antenna 104 would be connected to housing 132 and housing portion 135 would not be present. The LCD 144 and speaker 148 (referring to FIG. 5) would be on housing 132.

Figure 9:
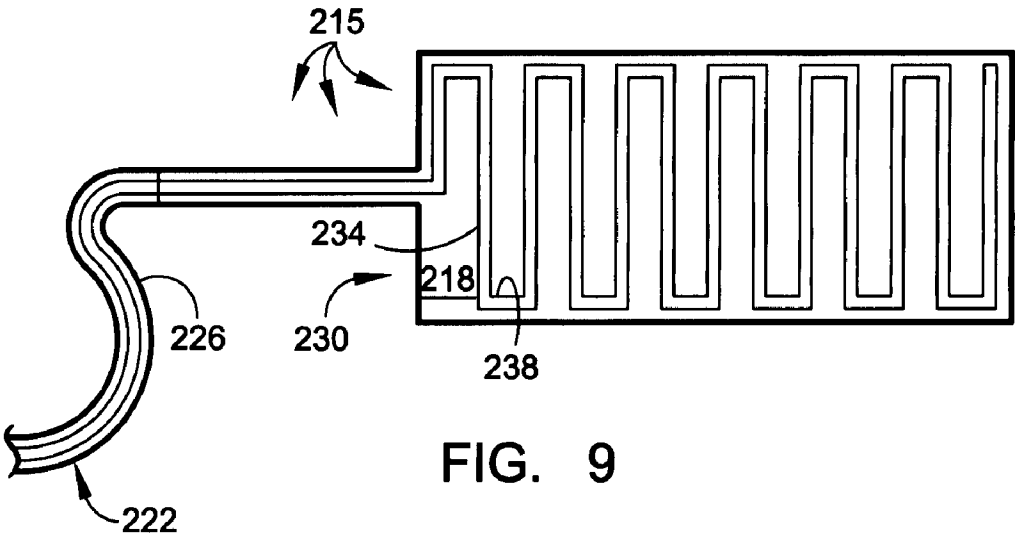
FIG. 9 illustrates a plan view of a printed meander radiator for use with the mobile wireless communication devices shown with respect to FIGS. 1–8.

FIGS. 9 illustrates a printed meander radiator 215. Printed meander radiator 215 can be used in rotatable antenna 104, fixed antenna 154 or loop antenna 260. If used in rotatable antenna 104 (in place of antenna coil 200), a separate loading spring would be used.

Printed meander radiator 215 is printed conductor (e.g., a metal such as aluminum, copper, silver or gold) on flexible material layer 218. For example, flexible material 218 may be polyvinyl chloride, polybutelene terepthalate, polycarbonate or another convenient flexible material. Printed meander radiator 215 includes a feed point 222 for connection to a PWB (not shown) and feed line 226. Feed line 226 connects to radiator element 230. Radiator element 230 includes a plurality of transverse lines 234 and longitudinal lines 238. By meandering many times transversely and longitudinally, lines 234 and 238 increase the effective electrical length of radiator element 230. The effective electrical length of radiator element 230 can be increased even more by curling flexible material layer 218 into a cylindrical shape.

Figure 10:
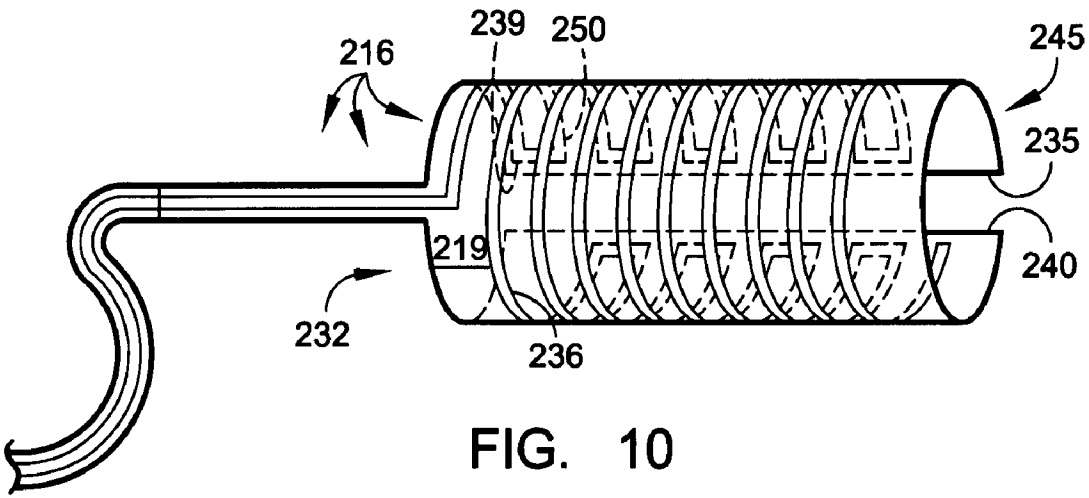
FIG. 10 illustrates a perspective view of an alternate printed meander radiator for use with the mobile wireless communication devices shown with respect to FIGS. 1–8.

FIG. 10 illustrates printed meander radiator 216 with radiator element 232 curved into a cylindrical shape 245. As can be seen by large-dash dashed lines 235 and 240, flexible material 219 has been curved around behind itself, to form cylindrical shape 245. As can be seen by small-dash dashed lines 250, transverse meander lines 236 curve around back toward themselves while longitudinal meander lines 239 are placed closer to each other. Further, transverse meander lines 236 are each formed into a loop shape. Alternatively, flexible material 219 could be formed into a "V" shape, a rectangle shape or any other convenient shape. Any shape besides a pure planar shape, such as, for example, a "V" shape or a rectangular shape, could be used to increase the electrical length of printed radiator 232 compared to printed radiator 230 and is defined herein to be a cylindrical shape.

FIGS. 9–10 show feed line 226 adjacent to printed radiator 230 and 232. As such, printed radiators 230 and 232 form "bottom fed" antennas. However, feed line 226 could be folded back in front of or behind printed radiator 230 or folded down along radiator 232. As such, printed radiator 230 or 232 would be "top fed".

While embodiments and implementations of the invention have been shown and described, it should be apparent that many more embodiments and implementations are within the scope of the invention. Accordingly, the invention is not to be restricted, except in light of the claims and their equivalents.

What is claimed is:

1. A mobile wireless communication device comprising:

(a) a housing; and, (b) an antenna connected to the housing, the antenna comprising:

a first antenna connecting portion connected to the housing;

a second antenna connecting portion detachably connected to the housing; and a loop portion, the loop portion being separated from the housing, forming a gap between the housing and the loop portion.

2. The mobile wireless communication device of claim 1, further comprising:

(c) a latch comprising:

a first latch connecting portion; and a second latch connecting portion, the first latch connecting portion connected to the antenna, the second latch connecting portion connected to the housing, wherein the first latch connecting portion and the second latch connecting portion are detachably connectable.

3. The mobile wireless communication device of claim 1, further comprising:

(d) a spring connected to the housing and to the antenna and configured to load the antenna away from the housing.

4. The mobile wireless communication device of claim 1, the antenna further comprising:

(e) an antenna feed port connected to the first antenna connecting portion; and (f) a ground connector connected to the second antenna connecting portion.

5. The mobile wireless communication device of claim 4, wherein the ground connector comprises a spring contact integrated with the antenna.

6. The mobile wireless communication device of claim 1, further comprising:

(g) a feed point comprising:

a spring contact integrated with the antenna.

7. The mobile wireless communication device of claim 1, wherein the housing comprises:

a first housing portion; and a second housing portion rotatably connected to the first housing portion.

8. The mobile wireless communication device of claim 7, wherein the antenna has a first axis of rotation relative to the first housing portion and wherein the second housing portion has a second axis of rotation relative to the first housing portion and wherein the first axis of rotation and the second axis of rotation are skewed.

9. The mobile wireless communication device of claim 8, wherein the first axis of rotation and the second axis of rotation form a 90 degree angle when viewed along a direction normal to a first plane which is parallel to a second plane, the first plane passing through the first axis of rotation and the second plane passing through the second axis of rotation.

10. The mobile wireless communication device of claim 1, wherein the antenna comprises:

a cylindrical meander line.

11. The mobile wireless communication device of claim 10, wherein the cylindrical meander line comprises a metal printed on a flexible material.

12. The mobile wireless communication device of claim 11, wherein the flexible material comprises a polymer.

13. The mobile wireless communication device of claim 11, wherein the flexible material comprises polyvinyl chloride, polybutelene terepthalate, or polycarbonate.

14. A mobile wireless communication device comprising:

(a) a housing means for housing electronic components; and (b) a radiating means for radiating electromagnetic signals, the radiating means connected to the housing and comprising:

a first antenna connecting means for connecting the radiating means to the housing means;

a second antenna connecting means for detachably connected the radiating means to the housing means; and a loop means for separating the radiating means from the housing means, the loop means forming a gap between the housing means and the loop means.

15. The mobile wireless communication device of claim 14, further comprising:

(c) a latch means for detachably connecting the radiating means to the housing means, the latch means comprising:

a first latch connecting means for detachably connecting the radiating means to the housing means; and a second latch connecting means for detachably connecting the radiating means to the housing means, wherein the first latch connecting means and the second latch connecting means are detachably connectable.

16. The mobile wireless communication device of claim 14, further comprising:

(d) a spring means for providing loading force, the spring means connected to the housing means and to the radiating means and configured to load the radiating means away from the housing means.

17. The mobile wireless communication device of claim 14, the radiating means further comprising:

(e) an antenna feeding means connected to the first antenna connecting means; and (f) a ground connecting means connected to the second antenna connecting means.

18. The mobile wireless communication device of claim 17, wherein the ground connecting means comprises a spring contact means integrated with the radiating means.

19. The mobile wireless communication device of claim 14, wherein the radiating means comprises:

(h) a cylindrical meander line means for increasing the electrical length of the radiating means.

20. The mobile wireless communication device of claim 19, wherein the cylindrical meander line means comprises a metal printed on a flexible material means for bending the radiating means.

21. The mobile wireless communication device of claim 20, wherein the flexible material means comprises a polymer.

22. The mobile wireless communication device of claim 20, wherein the flexible material means comprises polyvinyl chloride, polybutelene terepthalate, or polycarbonate.

* * * * *